US006942366B2

(12) United States Patent
Mohacsi

(10) Patent No.: US 6,942,366 B2
(45) Date of Patent: Sep. 13, 2005

(54) SIGN ILLUMINATION LIGHT FIXTURE

(75) Inventor: Ferenc Mohacsi, Muskego, WI (US)

(73) Assignee: Everbrite, LLC, Greenfield, WI (US)

( * ) Notice: Subject to any disclaimer, the term of this patent is extended or adjusted under 35 U.S.C. 154(b) by 51 days.

(21) Appl. No.: 10/625,190

(22) Filed: Jul. 23, 2003

(65) Prior Publication Data

US 2005/0018430 A1 Jan. 27, 2005

(51) Int. Cl.[7] ..... F21V 7/00

(52) U.S. Cl. ..... 362/300; 362/263; 362/216; 362/307; 362/812

(58) Field of Search ..... 362/300, 559, 362/812, 260, 263, 265, 346, 347, 223, 216, 297, 299, 301, 307, 308, 311, 328, 330, 331; 40/540, 545, 563, 572, 582, 583

(56) References Cited

U.S. PATENT DOCUMENTS

| | | | | |
|---|---|---|---|---|
| 1,939,288 | A | * 12/1933 | Allison | 40/545 |
| 2,641,687 | A | 6/1953 | Akely | |
| 3,705,300 | A | 12/1972 | Plemmons et al. | |
| 3,852,588 | A | * 12/1974 | Crawford | 362/297 |
| 4,004,144 | A | 1/1977 | Chako | |
| 4,287,554 | A | 9/1981 | Wolff | |
| 4,393,323 | A | 7/1983 | Hubner | |
| 4,418,378 | A | 11/1983 | Johnson | |
| 4,992,916 | A | 2/1991 | Henkes | |
| 5,475,576 | A | * 12/1995 | Daniels | 362/222 |
| 5,481,445 | A | 1/1996 | Sitzema et al. | |
| 5,570,525 | A | 11/1996 | Paglieri et al. | |
| 5,574,335 | A | 11/1996 | Sun | |
| 5,743,634 | A | 4/1998 | Sitzema et al. | |
| 5,967,648 | A | * 10/1999 | Barnes et al. | 362/307 |
| 5,988,829 | A | 11/1999 | Holder | |
| 6,062,704 | A | 5/2000 | Holder | |
| D430,339 | S | 8/2000 | Reo | |
| 6,246,183 | B1 | 6/2001 | Buonavita | |
| 6,339,296 | B1 | 1/2002 | Goral | |
| 6,433,492 | B1 | 8/2002 | Buonavita | |
| 6,457,844 | B2 | 10/2002 | Hess | |
| 6,626,562 | B2 * | 9/2003 | Blanchard | 362/346 |

OTHER PUBLICATIONS

Osram Sylvania, Product Information Bulletin ICETRON, Inductively Coupled Electrodeless Systems, pp. 1–4, Osram Sylvania, Westfield IN, available May, 1999.

Philips, 165 Watt QL Induction Lighting Lamp System, pp. 1–2, Philips Lighting Company, Somerset NJ available before Jul., 2003.

Philips, Induction Lamps QL lamp 55W, 85W, 165W, pp. 1–6, Philips Lighting Company, Somerset NJ, available before Jul., 2003.

* cited by examiner

*Primary Examiner*—John Anthony Ward
*Assistant Examiner*—Bao Q. Truong
(74) *Attorney, Agent, or Firm*—Michael Best & Friedrich LLP

(57) ABSTRACT

The invention provides a light fixture for illuminating a sign. The light fixture has a lamp and one or more reflectors to provide for substantially uniform illumination of a sign with a minimum number of light fixtures. One or more of the reflectors of some embodiments can formed from a material having predetermined pattern for reflecting and transmitting light from the lamp. For example, the reflectors can be made from a neutral density polymeric material consisting of a translucent or substantially transparent polymeric substrate with a pattern of reflective media disposed on or within the substrate. In some embodiments, one of the reflectors can be a specular reflector. Some embodiments of the light fixture can also include a thermal shield to at least partially prevent thermal convection along a portion of the lamp.

10 Claims, 8 Drawing Sheets

SIGN ILLUMINATION LIGHT FIXTURE

FIELD OF INVENTION

This invention relates generally to light fixtures, and more particularly to light fixtures used to illuminate signs.

BACKGROUND OF THE INVENTION

Lamps are used to illuminate signs, such as street signs, billboards, business signs, and the like. Many of these signs, however, are not easily accessible without special equipment. For example, in some instances a lift truck needs to be used to access the sign. Thus, if one or more of the lamps used to illuminate the sign were to burn out, it can be quite expensive to change the lamp(s).

Some lamp manufacturers have recognized this problem and have developed high reliability lamps or bulbs that have substantially longer lives than conventional lamps. For example, these long-life lamps can last about five to ten times longer than conventional lamps. Since high reliability lamps need to be changed less often, the added labor and equipment costs to change the lamps occur less often. However, high reliability lamps are much more expensive than conventional lamps.

Since many lamps are used outdoors, they are subject to temperature extremes. For example, in some environments the lamp can be subjected to extremely low outdoor air temperatures. Unfortunately, typical high reliability lamps do not emit as much light in relatively cold temperatures as compared to relatively warm temperatures. Thus, the added expense of these high reliability lamps may not be practical in some environments due to lack of light emitted in cold temperatures.

Conventional fluorescent lamps used in signs are long, linear tubes which inherently distribute light evenly over large areas. On the other hand, high reliability lamps are often compact tubes, which require reflectors to evenly distribute the output light over large areas.

SUMMARY OF THE INVENTION

The present invention provides a light fixture for illuminating a sign. The light fixture according to some embodiments of the present invention has a lamp and one or more reflectors positioned adjacent the lamp to provide for substantially uniform illumination of a sign with a minimum number of light fixtures. One or more of the reflectors may have a predetermined pattern of substantially transparent areas and reflective areas to allow some light to be transmitted through the reflector and to reflect the remainder of the light. In other embodiments, one of the reflectors can be a totally reflective specular reflector. Some embodiments of the light fixture can also include a thermal shield to at least partially prevent thermal convection along some of the lamp in cold ambient temperatures.

One embodiment of the present invention provides a light fixture, comprising a closed loop, high intensity discharge lamp, a first reflector at least partially disposed on a first side of the lamp, and a second reflector positioned on a second side of the loop opposite the first side. The lamp can be an electrodeless lamp. Specifically, the lamp can comprise a hollow, closed loop tube at least partially filled mercury vapor, the lamp illuminated by electromagnetic induction from one or more transformers adjacent to the tube.

In some embodiments, both reflectors can be controlled light distributors or transflective reflectors that allows both direct and indirect illumination of the sign with the lamp, while in other embodiments the reflector on the backside of the fixture is a totally reflective specular reflector. The transflective reflectors can be made from a neutral density polymeric material that includes a polymeric substrate having a predetermined pattern for reflecting and transmitting light from the lamp. The reflectors can be wing shaped, having a central portion adjacent the lamp and two cantilevered portions extending from the central portion in substantially opposite directions. Specifically, the cantilevered portions can extend from the central portion along a curved path. More specifically, the central portion can be concave with respect to the lamp and the cantilevered portions can be convex with respect to the lamp. Note that the described shape is only one of many possible shapes for the reflectors.

Some embodiments of the light fixture also include a thermal cover positioned over one end of the light fixture to at least partially enclose a portion of the light fixture. The cover can comprise an end located adjacent to the end of the light fixture and oriented substantially perpendicular to the lamp and the reflectors; and at least one side wall coupled to and positioned substantially perpendicular to the end of the cover. More specifically, the cover can include an end wall and four side walls that are substantially parallel to the longitudinal axis of the lamp.

In some embodiments, a plurality of light fixtures can be coupled to one or more ballasts in parallel to illuminate a sign housing having a first output panel that has a diffusive, translucent surface adjacent the first reflector. Additionally, the sign housing can further comprise a second output panel located on the opposite side of the light fixtures from the first output panel, the second output panel having a diffusive, translucent surface adjacent the second reflector. The sign housing can further comprise at least one side wall and/or a back wall, each having a diffusive reflective surface or a diffusive, translucent surface adjacent the light fixtures.

Further aspects of the present invention, together with the organization and operation thereof, will become apparent from the following detailed description of the illustrated embodiments when taken in conjunction with the accompanying drawings, wherein like elements have like numerals throughout the drawings.

BRIEF DESCRIPTION OF THE DRAWINGS

The present invention is further described with reference to the accompanying drawings, which illustrate certain embodiments of the present invention. It is to be understood that the invention is not limited in its application or construction to the details of construction and the arrangements of the components set forth in the following description or illustrated in the drawings. Rather, the invention disclosed in the accompanying drawings is illustrated by way of example only. Also, it is understood that the phraseology and terminology used herein is for the purpose of description and should not be regarded as limiting. For example, the description of certain drawings or the elements within certain drawings may use terms such as "front," "side," "top," "bottom," and the like. These terms should not be read as limiting upon the orientation of the present invention. Rather, they are only used to help describe the illustrated embodiments (and alternatives thereto). The various elements and combinations of elements described below and illustrated in the drawings can be arranged and organized differently to result in embodiments which are still within the spirit and scope of the present invention.

In the drawings, wherein like reference numeral indicate like parts.

DETAILED DESCRIPTION OF THE ILLUSTRATED EMBODIMENTS

Figure 1:
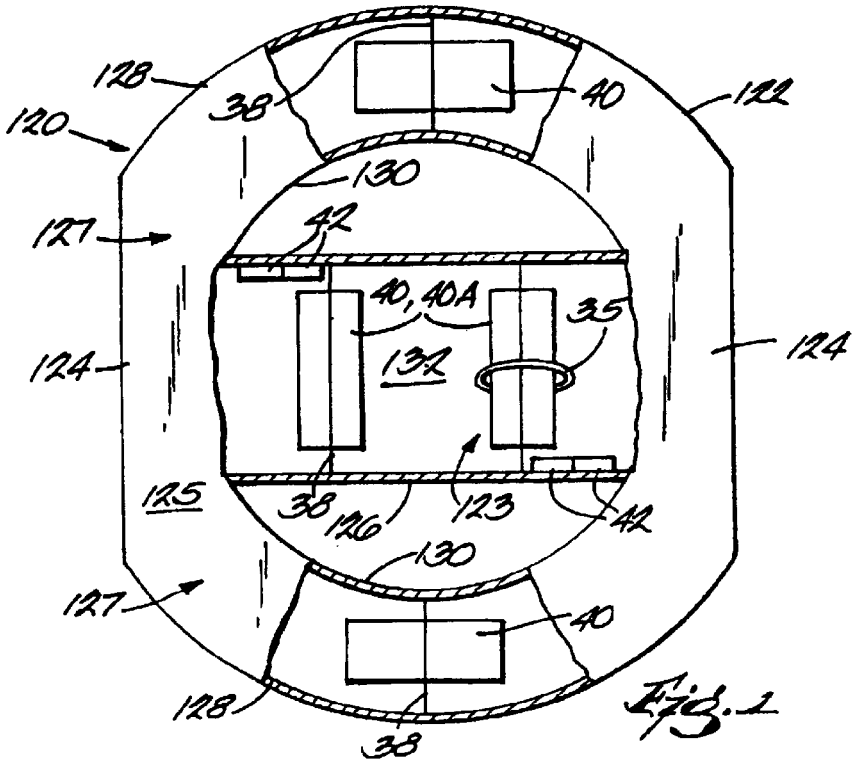
FIG. 1 is a front view of a sign with its fascia or output panel partially removed to show one arrangement of light fixtures of the present invention within the sign.
Figure 2:
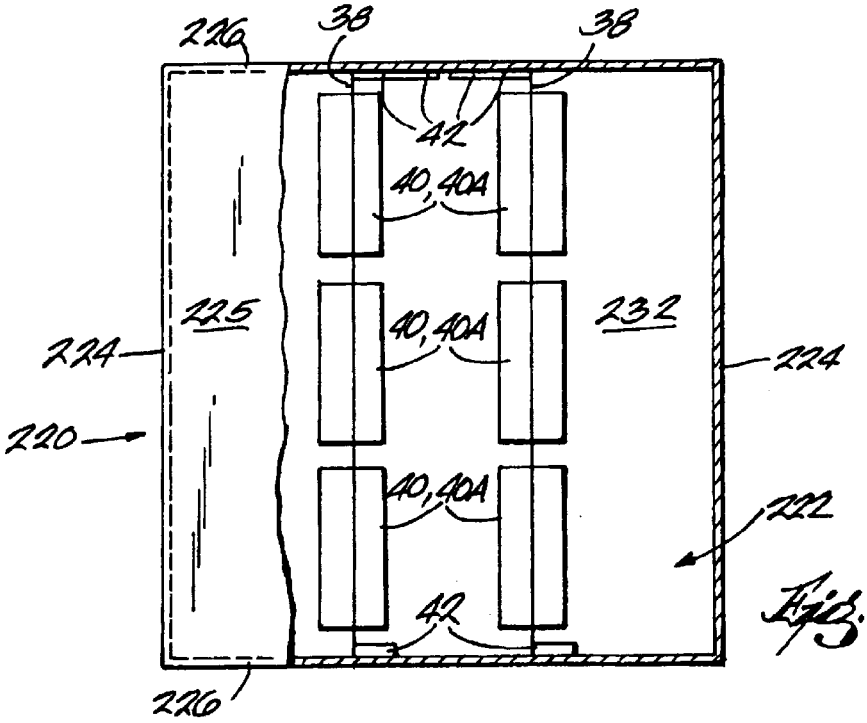
FIG. 2 is a front view of another sign with its fascia or output panel partially removed to show another arrangement of light fixtures within the sign.

FIGS. 1 and 2 each illustrate a sign 120, 220 embodying the present invention. The signs 120, 220 each include a housing 122, 222 having at least one output panel (front output panel not shown) and one or more light fixtures 40, 40A (hereinafter "light fixtures" regardless of number) positioned within the housing 122, 222 to illuminate the at least one output panel in a substantially uniform manner.

The housing 122 shown in FIG. 1 has a rectangular portion 123 and two curved portions 127 located on opposite sides of the rectangular portion 123. The rectangular portion 123 of the housing 122 is defined by opposing sides 124, opposing sides 126, a portion of the back wall 132, and a portion of the front output panel 125 (partially removed). The two curved portions 127 of the housing 122 are defined by a relatively large radius wall 128, a relatively small radius wall 130, a portion of the back wall 132, and a portion of the front output panel 125 (partially removed). The illustrated portions as well as the overall shape of the housing are merely exemplary. Thus, in other embodiments, the housing can have a different number of components positioned and shaped differently and defined by different walls. For example, the housing 222 of the sign 220 illustrated in FIG. 2 only has a rectangular portion 223 defined by opposing walls 224, 226, the back wall 232, and the front output panel 225 (partially removed). In yet other embodiments, the housing can be circular, spherical, triangular, substantially any other multi-sided shaped, or the like. Additionally, it may have other amorphous shapes which cannot be easily described herein.

The housing 122, 222 can be made of substantially any material. For example, in some embodiments the housing 122, 222 is made of metal, plastic, and the like. More specifically, the housing 122, 222 can have an interior surface or coating that is diffusive reflective to help disperse light uniformly.

As illustrated in FIGS. 1 and 2, support structures, such as posts 38, extend between walls of the housing 122, 222 to support the light fixtures 40, 40A. Specifically, two posts 38 extend between opposing walls 126, 226 as illustrated. As will be described in greater detail below, the light fixtures 40, 40A are coupled to the posts 38 by one or more fasteners, such as a threaded fastener, adhesive/cohesive bond, welds, nails, and the like. As shown in FIG. 1, the light fixtures 40, 40A can be oriented in substantially any direction when coupled to the posts 38. The two fixtures 40, 40A located in the rectangular portion 123 of the housing 122 are oriented vertically, while the fixtures 40, 40A located in the curved portion 127 of the housing 122 are oriented in a substantially horizontal manner. These orientations are merely exemplary. Thus, the fixtures 40, 40A in other embodiments can be disposed at other angles.

As shown in FIG. 2, more than one light fixture 40, 40A can be located upon each post 38. When more than one fixture 40, 40A is supported upon a post 38, the fixtures 40, 40A can be electrically connected in series or parallel. Preferably, the fixtures are connected in parallel.

One or more ballasts 42 (hereinafter "ballasts" regardless of number) or power supplies can also be supported within the housing 122, 222 to power the light fixtures 40. As shown in FIGS. 1 and 2, the four ballasts 42 are coupled to opposing walls 126 of the housing 122 to power the light fixtures 40. Although each light fixture 40, 40A is powered by a separate ballast 42 in the illustrated signs 20, more than one light fixture can be powered by the same ballast in other embodiments. Additionally, the ballasts can be located in other areas. For example, the ballasts 42 can be positioned adjacent to the light fixtures 40, 40A, to other walls of the housing 122, the exterior of the housing, or an area outside of the sign.

Figure 3:
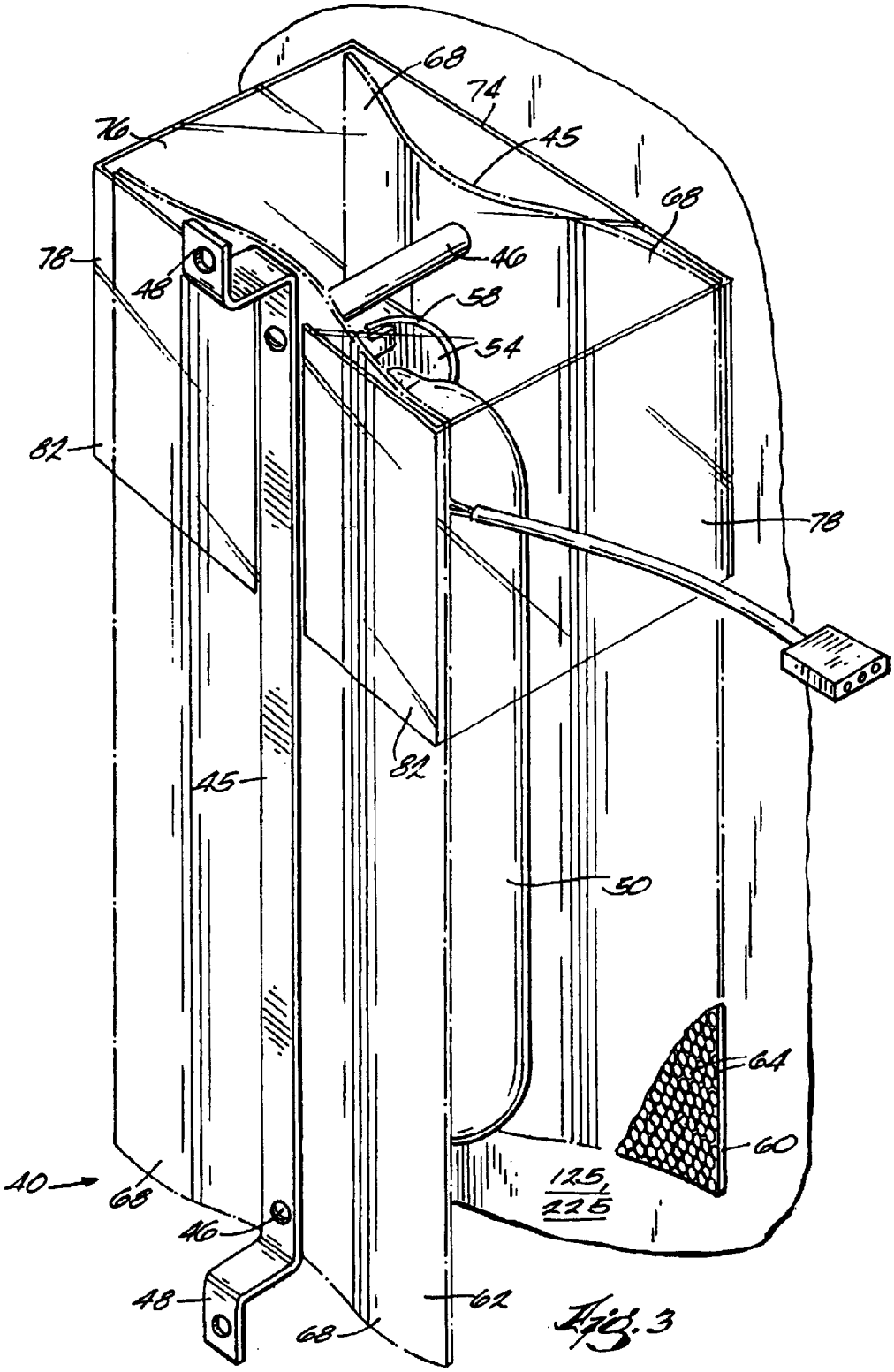
FIG. 3 is a perspective view of one embodiment of a light fixture embodying the present invention in combination with a thermal cover.

The light fixtures 40, 40A embodying the present invention will now be described in greater detail with reference to FIGS. 3–11. As shown in FIG. 3, one embodiment of the light fixture 40 is illustrated. This light fixture has a frame 44, two reflectors 60, 62 coupled to the frame 44, and a lamp 50 coupled to the frame 44 and located between the reflectors 60, 62. It should be noted that as used herein and in the appended claims, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. Examples include directly securing one element to another (e.g., via welding, bolting, gluing, frictionally engaging, mating, etc.), elements which can act upon one another (e.g., via camming, pushing, or other interaction), one element imparting motion directly or through one or more other elements to another element, and one element electrically connected to another element either directly or through a third element.

The frame 44 of the illustrated embodiment has two longitudinal frame members 45 running along and coupled to the reflectors 60, 62. One of the longitudinal frame members 45 is positioned adjacent to one of the reflectors 60, which will be referred to as the front reflector 60. The other longitudinal frame member 45 is positioned adjacent to the other reflector 62, which will be referred to as the back or rear reflector 62. As previously noted, these terms (front, back, and rear) are merely used for the ease of description and should not be construed as a limitation upon the present invention. The longitudinal frame member 45 that runs along the rear reflector 62 has bracketed ends 48, which can be used to mount the light fixtures 40 to the support structures of the sign. The two longitudinal frame members 45 are coupled together with transverse frame members 46. The illustrated embodiment only illustrates one type of frame. Other frame structures are known to those having ordinary skill in the art and fall within the spirit and scope of the present invention. For example, in some embodiments the longitudinal frame members 45 can be omitted.

Figure 4:
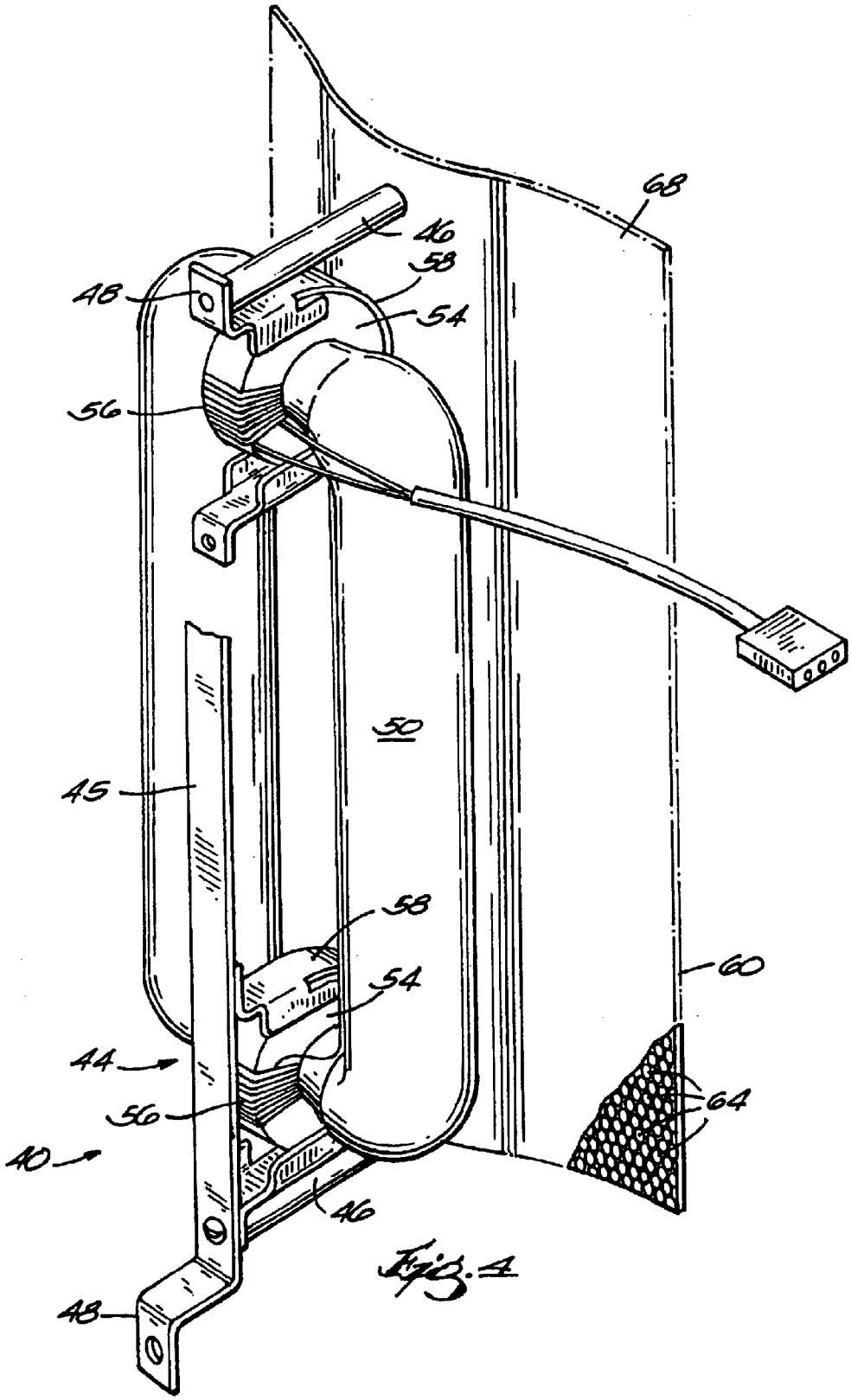
FIG. 4 is a partial perspective view of the embodiment shown in FIG. 3 with the thermal cover and the rear reflector removed.

As shown in FIGS. 3 and 4, the reflectors 60, 62 are coupled to the frame 44. More specifically, the reflectors 60, 62 are sandwiched between the longitudinal frame members 45 and the ends of the transverse frame members 46. One having ordinary skill in the art will recognize that this is just one manner of coupling the reflectors 60, 62 to the light fixture 40. Other manners of coupling are known in the art and fall within the spirit and scope of the present invention.

Figure 5:
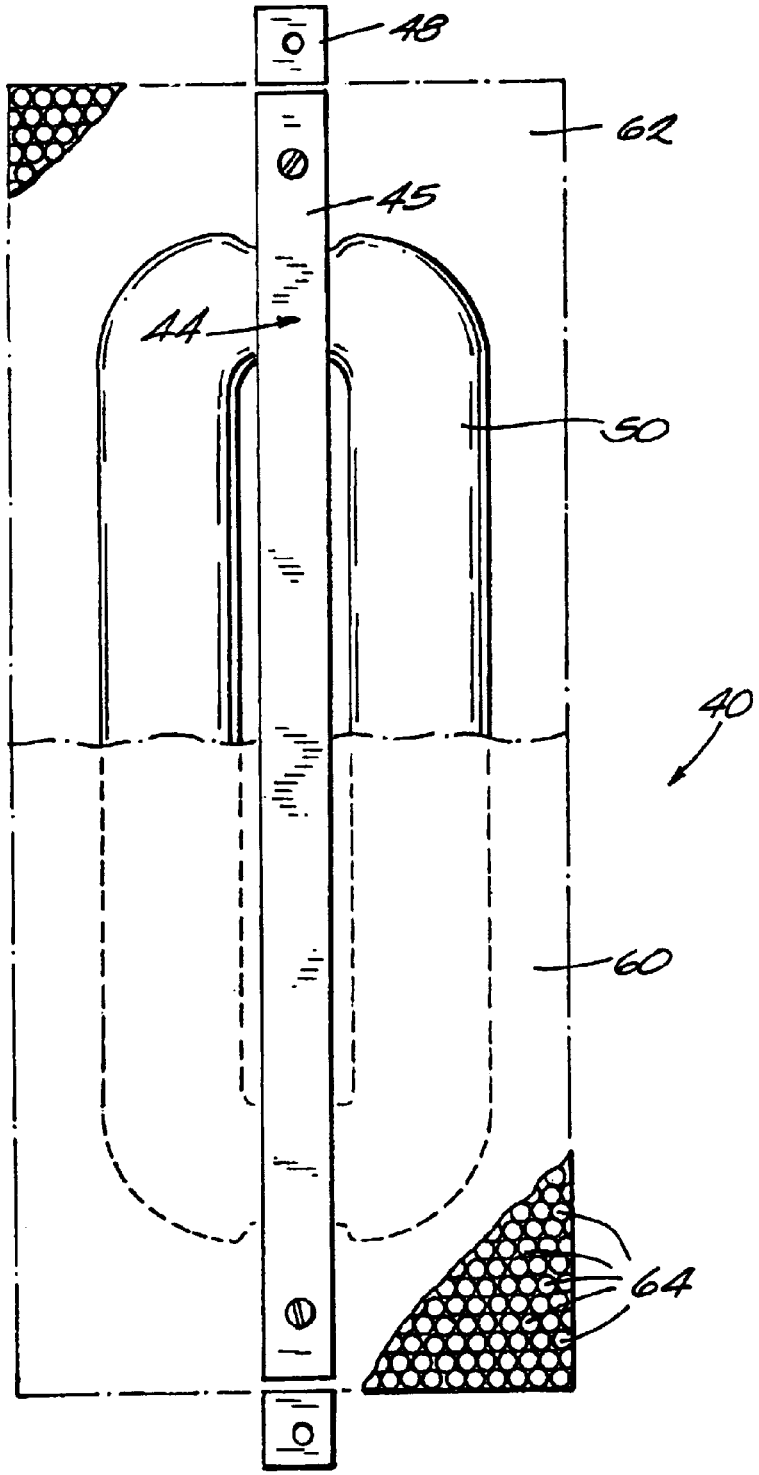
FIG. 5 is a front view of the light fixture shown in FIG. 3 with the front reflector partially removed.
Figure 6:
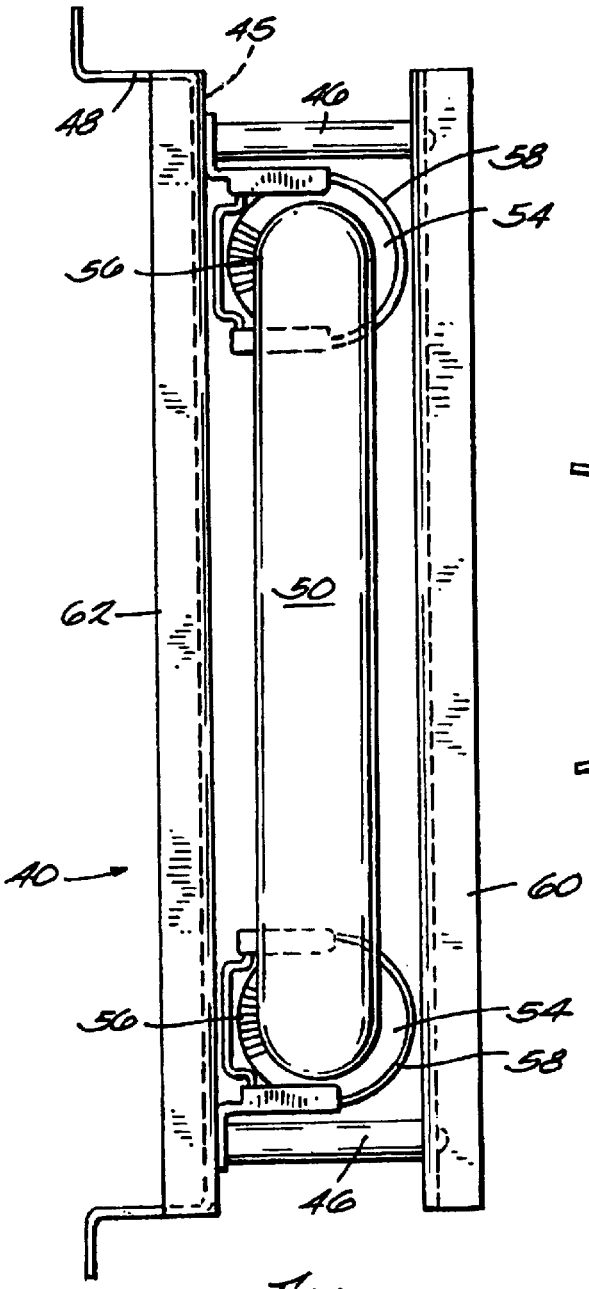
FIG. 6 is a side view of the light fixture shown in FIG. 3.
Figure 7:
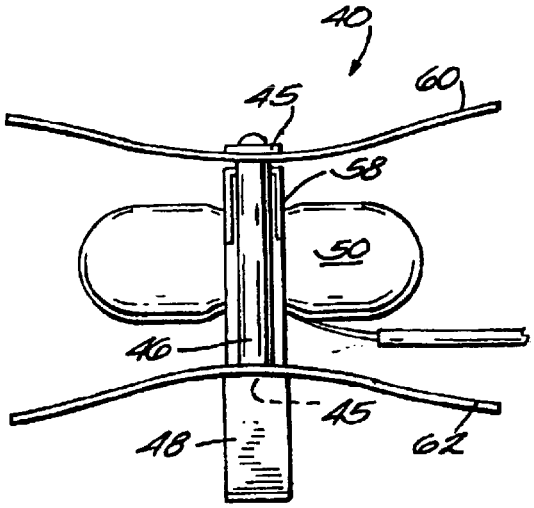
FIG. 7 is a top view of the light fixture shown in FIG. 3.

As best illustrated in FIGS. 5–7, the front reflector 60 is laterally spaced apart from the rear reflector 62 and the lamp 50 is positioned between the two reflectors 60, 62. Furthermore, each reflector 60, 62 has an outer periphery that can extend beyond the outer periphery of the lamp. As illustrated in FIGS. 1 and 2, reflectors are preferably oriented within the housing 122, 222 so that the front reflector 60 is preferably space about six to eighteen inches from the front output panel 125, 225 (partially removed), and more preferably at least 12 inches from the front output panel 125, 225. Similarly, the rear reflector 62 is preferably positioned about 6 to 18 inches from the back wall 132, 232 depending upon the type reflector used. Note that in some embodiments, the rear reflector 62 can be omitted and the back wall 132, 232 of the housing can be used as a reflector. In such a situation, the space between the fixture and the back wall may be less than six inches. The illustrated orientation and configuration of the reflectors 60, 62 can help prevent bright spots when viewing the sign, as well as providing for uniform illumination of a sign through side emission of light in a direction generally parallel to a plane defined by the loop of the lamp 50.

The construction of each reflector can depend upon the type of sign 20 being illuminated. For example, the embodiment illustrated in FIGS. 3–7 can have particular utility illuminating a sign have both a front and rear output panel, such as a double sided business sign. Additionally, as will be described in greater detail below, the embodiment illustrated in FIGS. 8–11 can have particular utility illuminating a sign having only a front output panel and a non-illuminated rear surface. However, either fixture can be used for other applications.

Returning to FIGS. 3–7, the front reflector 60 is a mirror image of the rear reflector 62. Each reflector 60, 62 is wing-shaped with a substantially planar central body portion 66 positioned adjacent to the longitudinal frame members 45, and two cantilevered portions 68 extending in opposite directions from the central portion 66. In some embodiments, such as the illustrated embodiment, the cantilevered portions 68 extend from the central portion 66 along a curved path, such as a partially parabolic path. As such, the central portion 66 is convex with respect to the lamp 50 and the cantilevered portions are concave with respect to the lamp 50. One having ordinary skill in the art will understand that this is but one of many possible shapes that the reflectors can have. For example, the cantilever portions 68 of the reflectors 60, 62 can be planar, curved, angled, and the like. Additionally, one reflector can have a different shape than the other reflector.

The reflectors 60, 62 illustrated in FIGS. 3–7 are considered controlled light distributors or transflectors because a portion of the light passes through the reflector and a portion is reflected. In other words, the material that the reflectors are made from allows both direct and indirect illumination from the lamp. The material of some embodiments is a neutral density polymeric material that includes a polymeric substrate having a predetermined pattern for reflecting some light from the lamp and transmitting some light from the lamp though the reflector. The polymeric material has a pattern on it or embedded in it made of a plurality of shapes, such as dots, squares, other polygons, and the like that can be either highly reflective or permit efficient transmission of incident light rays. The frequency, pattern, size, uniformity, density, and reflectivity of the shapes can be tailored for each application. For example, the material can be designed to reflect ninety percent of the light and transmit ten percent in some embodiments, while in other embodiments it can reflect thirty percent of the light and transmit seventy percent. The ratio of reflected light to transmitted light needed for each application can depend upon the nature of the lamp, the size and shape of the sign, the number of lamps located within the sign, and amount of light desired within the sign.

The neutral density polymeric material consists of a polymeric substrate this is translucent or substantially transparent with a pattern of reflective media disposed on or within the substrate. The neutral density polymeric material of some embodiments can include a heat transfer film applied to an acrylic, polycarbonate, or other polymeric substrate. The heat transfer film can be removed to leave a pattern on the substrate. The media disposed on the substrate can have a highly reflective, specular pattern. In other embodiments, the neutral density polymeric material can be made from an acrylic, polycarbonate, or other polymeric film that is metallized with aluminum, silver, or other reflective material. The metallization can have a predetermined pattern or can have a pattern etched into it. Other coatings can also be applied to the reflectors to protect the polymeric materials during cleaning.

The illustrated reflectors are made of a material known as LIGHT CONTROL FILM ®, which is neutral density polymeric material having a substrate carrying a predetermined pattern for reflecting and transmitting light made by LexaLite International Corporation of Charlevoix, Mich. More information on the LIGHT CONTROL FILM® is a available in U.S. Pat. No. 5,967,648, issued on Oct. 19, 1999 to Barnes, II et al. which is incorporated herein by reference.

Several different types of lamps 50 can be used in the light fixtures 40 of the present embodiment. The lamp of the illustrated embodiment, however, is a closed loop, high reliability, high intensity discharge lamp located adjacent the reflectors 60, 62. Specifically, the lamp 50 may be an inductively coupled electrodeless lamp, such as a SYLVANIA ICETRON™ lamp available from OSRAM SYLVANIA Products, Inc. of Danvers, Mass. Such lamps are configured as a sealed, closed loop vessel that uses electromagnetic-induction to energize the lamp and generate light. As illustrated, the lamps 50 may be made of a hollow glass tube that is bent onto itself in a closed, rectangular configuration. The inside wall of the vessel is coated with fluorescent paint and the inner volume is filled with a mixture of gases and mercury vapor. The lamp generates light when the voltage on the tube is sufficiently high to ionize the interior gases. When the lamp is thus energized, an AC lamp current flows within the tube.

Referring to FIG. 4, the lamp 50 is energized by an electromagnetic field produced by a pair of coupling transformers 52. The coupling transformers 52 each include a ferrite core 54 and windings 56. Each of the illustrated cores 54 are split cores so that they can be disposed about the lamp tube and retained by clamps 58 which secure the two halves together. These clamps 58 can also be used to couple the lamp to the frame of the fixture by any conventional means. Further details on the construction of the ICETRON™ lamp can be found in U.S. Pat. No. 6,433,492, issued on Aug. 13, 2002 to Buonavita, which is incorporated herein by reference. Briefly, the ICETRON™ system incorporates an electrodeless fluorescent lamp that is excited by a radio frequency (RF) magnetic field. The two large ferromagnetic (metal) cores create a magnetic field around the glass tube, using the high frequency generated by the RF power converter (ballast). The discharge path, induced by the ferrite cores, forms a closed loop. It is this inductively coupled field that initiates, excites, and maintains the interaction between the electrons and the phosphor within the tube, converting the UV light to visible light.

The coupling transformers 52 are driven by an electronic ballast or power supply 42 (see FIGS. 1 and 2), such as the QUICKTRONIC® I.C.E. ballast available from OSRAM SYLVANIA which operates at a frequency of 250 kHz, or any other suitable electronic ballast. The ballast 42 is capable of receiving power from a conventional utility power line.

Although the ICETRON lamp is designed to conform with all federal and European regulations for electromagnetic interference, some shielding may still be desirable in some applications to reduce such interference. As discussed above, the reflectors 60, 62, 62A of some embodiments can be at least partially made from a conductive material. The conductivity of the reflectors 60, 62, 62A in combination with a ground wire 35 can be used to further reduce or eliminate electromagnetic interference. The ground wire 35 can be wrapped around the light fixture 40, 40A one or more times as shown in FIG. 1 and attached to the frame 44, support post 38, or other conductive material to ground the light fixture. In other embodiments, the ground wire 35 is merely attached between one or more of the reflectors 60, 62, 62A and a ground.

Returning to FIG. 3, a thermal cover 74 is illustrated covering a portion of the light fixture 40. The cover can be made of substantially any material, but is preferably made of a substantially transparent material, such as clear polycarbonate plastic or glass. The thermal cover 74, such as the one illustrated, can be used in some embodiments to increase the output of the lamp 50 in cold weather. The cover can prevent excessive thermal convection along the lamp 50 and retains heat from the lamp to increase the amount of light emitted from the lamp 50. The retained heat can help to increase the temperature of the mercury in lamp 50. Thus, the cover preferably covers the mercury amalgam tip on the lamp to prevent convection around the tip and to increase the temperature of the mercury.

In other embodiments, the cover 74 is preferably positioned over at least a portion of the light fixture 40 extending downward from the most vertical surface (as mounted). For example, in some embodiments, the cover 74 can extend over as much as one-hundred percent of the lamp's height. More preferably, the cover 74 can extend to cover between twenty-five to fifty percent of the lamp 50. In some embodiments, more or less of the lamp 50 may be covered by the shield. In other words, depending upon the seasonal temperatures within a locality more or less convection may be desirable. For example, in environments that are relatively warm year-round, the cover probably should not extend over more than fifty percent of the lamp's height because some thermal convection needs to occur to keep the lamp within operational temperatures in relatively hot weather. Even in relatively cooler climates, it may not be desirable to cover more than fifty percent of the lamp's height because cool climates do tend to have some relatively warm days during summer.

As illustrated in FIG. 3, the thermal cover 74 has a top or end 76 that extends from the longitudinal end of the front reflector 60 to the end of the rear reflector 62. The cover 74 also has one or more side walls coupled to the top 76 and extending from the top down and around a portion of the light fixture 40. Specifically, the illustrated embodiment has a two opposing side walls 78 extending between the front reflector 60 and the rear reflector 62 and extending partially along the length of the lamp in the longitudinal direction from the top. The illustrated cover 74 also has a front wall 80 and a rear wall 82 extending between the two opposing side walls 78 adjacent to the front and rear reflectors respectively. The rear wall 82, as illustrated, is split into two sections with a longitudinal groove separating the two sections. This groove straddles the bracketed end 48 of the frame 44 to allow the cover to be easily added and removed.

In some embodiments, the cover 74 can be configured different than the illustrated embodiment. For example, the cover can have a circular top 76 and a side wall extending from the top 76 to form a cylindrical shape. In other embodiments, the cover 74 may be oriented differently depending upon the orientation of the light fixture 40. For example, if the light fixture were oriented normal to that shown in FIG. 3, the top 76 of the cover 74 could be positioned adjacent the longitudinally extending edge of the reflectors and the side walls 78–82 could extend down a face or edge of the reflectors. In yet other embodiments, the cover can be directly coupled to the reflectors. For example, in the embodiment illustrated in FIG. 3, front and rear walls 80, 82 of the cover can be omitted. Additionally, the top 76 and opposing side walls 78 can be fastened to the periphery of the reflectors or formed as part of the reflectors. Similar modifications can also be made to embodiments wherein the light fixture is oriented differently. These and other modifications known to those having ordinary skill in the art fall within the spirit and scope of the present invention.

FIGS. 8–11 illustrate an alternative embodiment of a light fixture 40A that is substantially the same as the light fixture 40 illustrated in FIGS. 3–7, with several exceptions. Like parts have been given like reference numerals. Like the previous embodiment, the light fixture 40A of this embodiment has a frame 44, reflectors 60, 62A coupled to the frame, and a lamp 40 positioned between the reflectors 60, 62A. However, unlike the previous embodiment, the rear reflector 62A of this embodiment is not a transflector or controlled light distributor. Rather, the rear reflector 62A is a specular reflector designed to reflect substantially all light incident upon it. Thus, this embodiment of the light fixture 40A can have particular utility illuminating a sign having only one (front) output panel and a non-illuminated rear surface. The rear reflector 62A of this embodiment can be made of many different materials, such as metal, glass, coated plastics, and the like.

Figure 8:
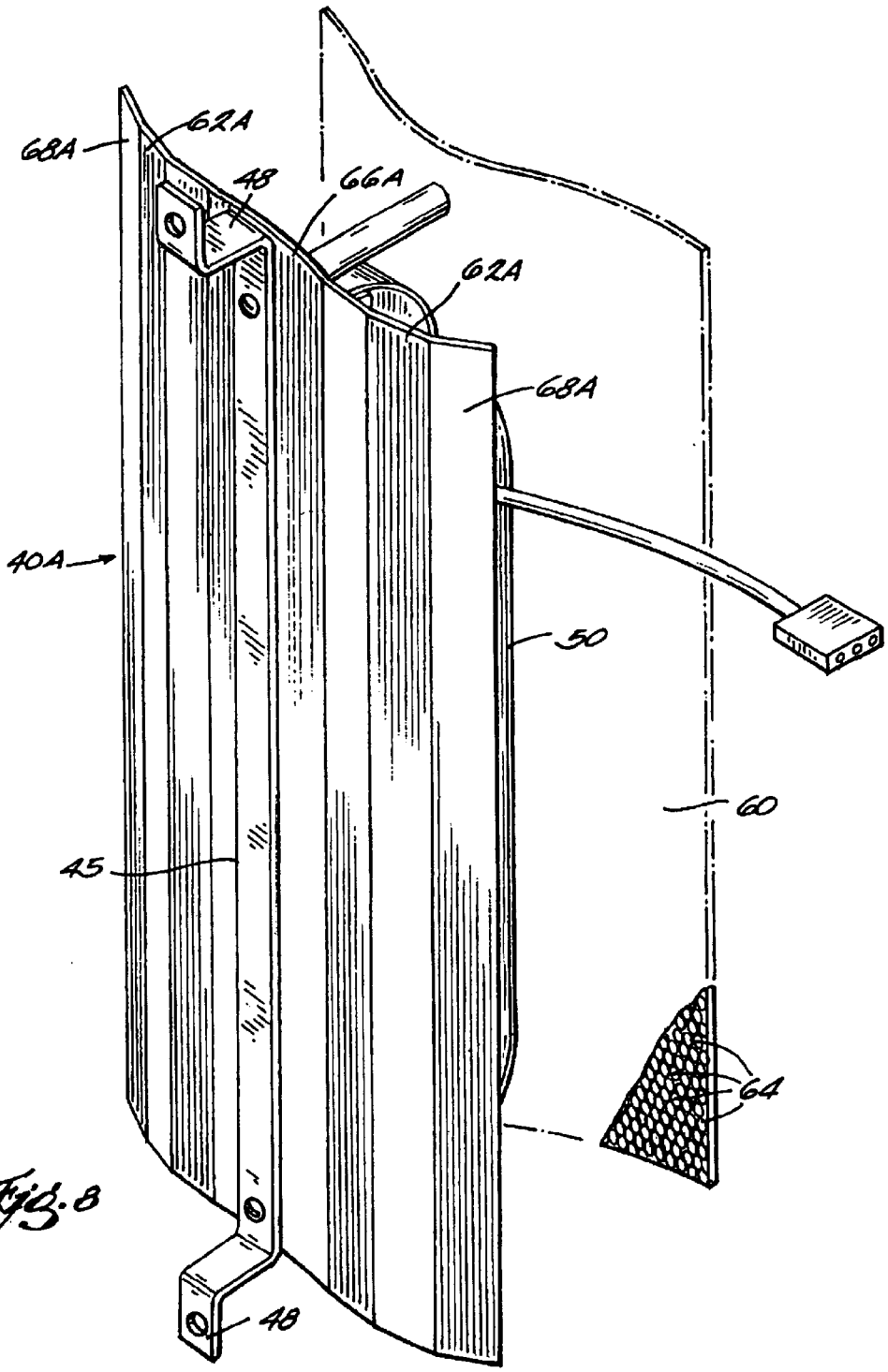
FIG. 8 is a perspective view of a second embodiment of the a light fixture embodying the present invention.

As illustrated in FIG. 8, the transmissive reflector 60 is preferably positioned adjacent the front output panel and the specular reflector 62A is positioned adjacent the rear surface of the sign 120, 220. As described in greater detail above, the transmissive reflector 60 provides substantially uniform illumination of the output panel without bright spots. The specular reflector 62A, however, reflects substantially all the light incident upon it. Thus, the light emitted from the lamp towards the back of the sign can be redirected towards a reflective side surface or the front of the sign. Additionally, other light, such as light reflected off the front reflector 60 or interior surfaces of the sign, can also be reflected by the rear reflector 62A towards a reflective side surface or the front of the sign.

Figure 9:
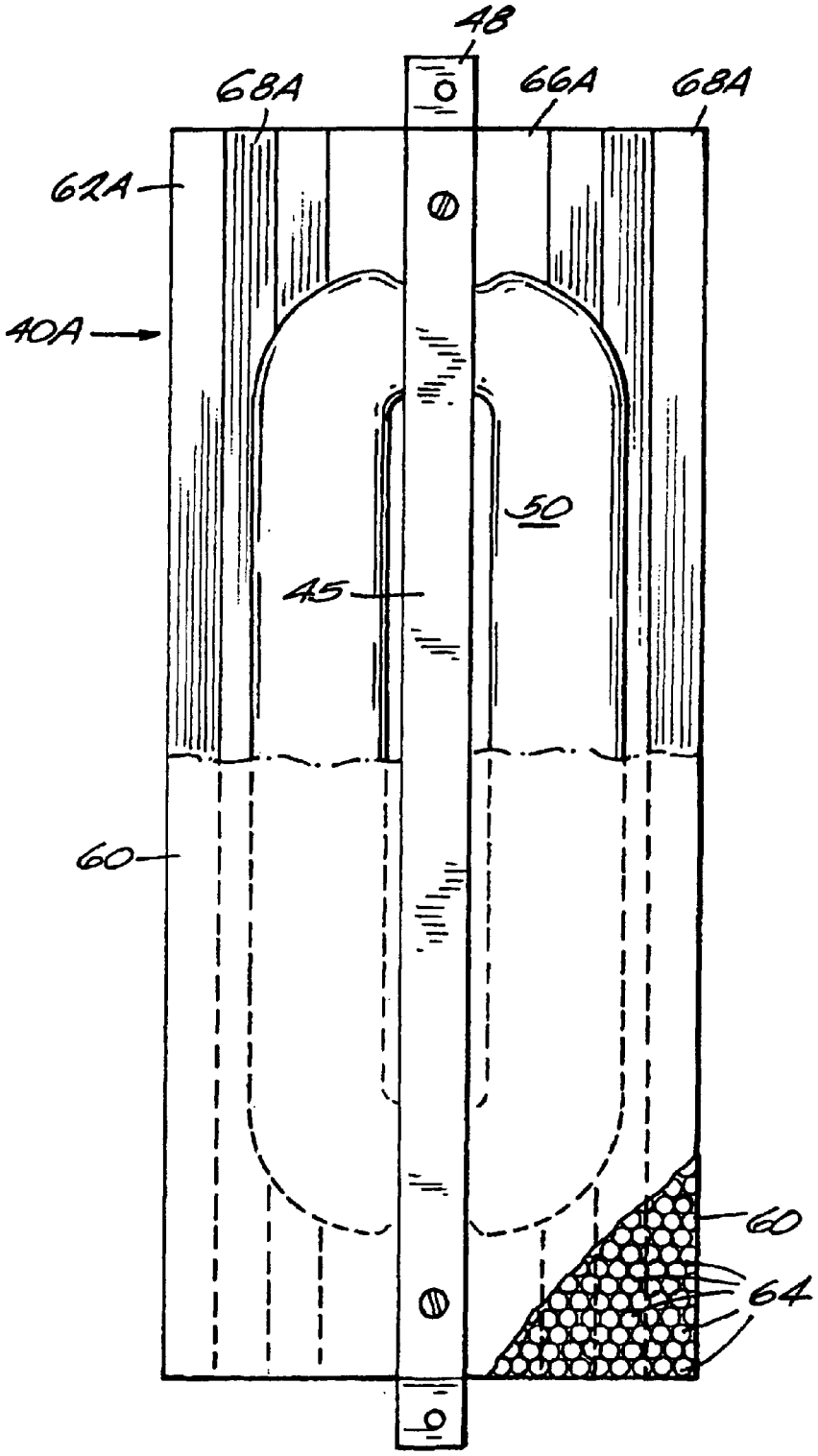
FIG. 9 is a partial front view of the light fixture illustrated in FIG. 8, showing the light fixture with the front reflector partially removed.
Figure 10:
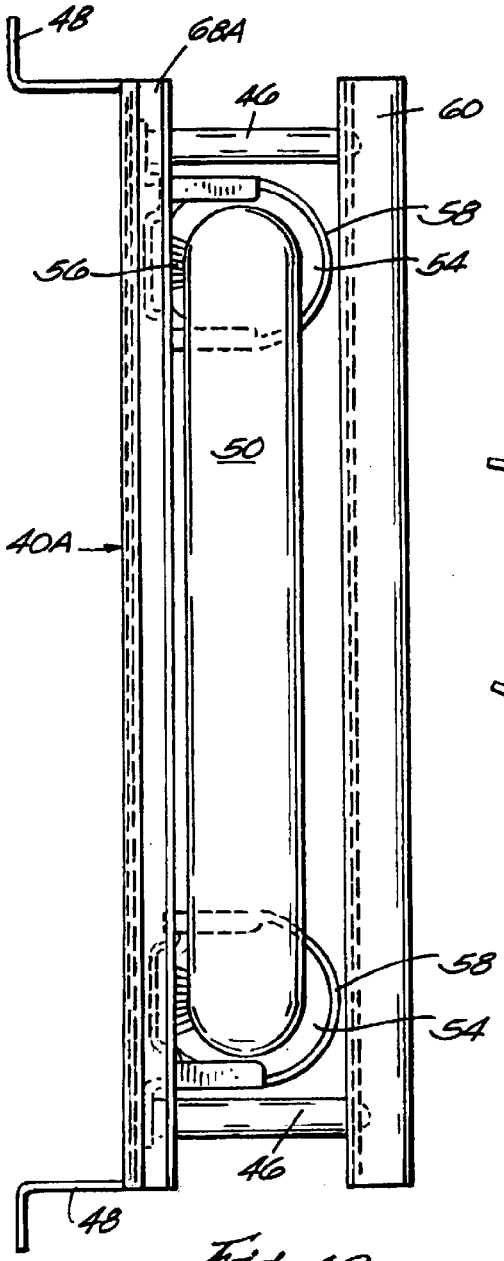
FIG. 10 is a side view of the light fixture illustrated in FIG. 8.
Figure 11:
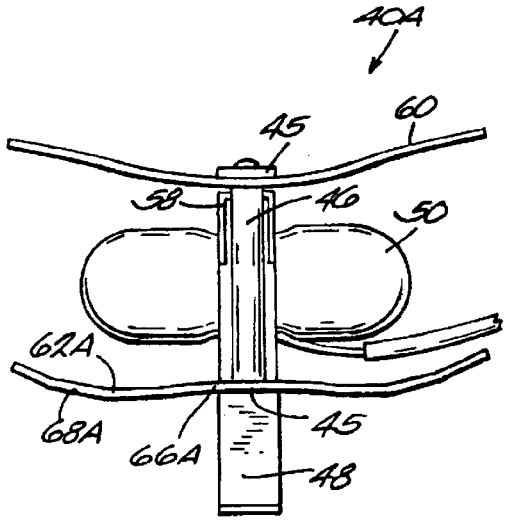
FIG. 11 is a top view of the light fixture illustrated in FIG. 8.

As shown in FIGS. 9–11, the rear reflector 62A can have a different shape than the front reflector. Specifically, the illustrated reflector 62A does not extend away from the lamp 50 along a curve path as great as the front reflector 60 or the reflector 62A of the previous embodiment. The rear reflector 62A, however, is not precluded from having the same shape. The size and shape of the rear reflector can depend upon the size and shape of a particular sign as well as the amount of illumination need. As illustrated, the rear reflector 62A has center portion 66A that is slightly convex with respect to the lamp 50 and two cantilevered ends 68A that extend away from the center portion along a curved path to form concave portions with respect to the lamp 50.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, the illustrated embodiments show the light fixtures 40 as being located within a housing of a sign. However, in other embodiments the light fixtures can be positioned on the exterior of the sign to illuminate the fascia of the sign, such as a bill board or highway sign. Also, note that various alternatives to the certain features and elements of the present invention are described with reference to specific embodiments of the present invention. With the exception of features, elements, and manners of operation that are mutually exclusive of or are inconsistent each embodiment described above, it should be noted that the alternative features, elements, and manners of operation described with reference to one particular embodiment are applicable to the other embodiments.

I claim:

1. A light fixture, comprising:

a closed loop, high intensity discharge lamp having an outer periphery;

a first reflector at least partially disposed on a first side of the lamp, the first reflector having a plurality of transmissive areas and a plurality of reflective areas allowing a portion of the light emitted from the lamp to transmit through the first reflector and a portion of the light to be reflected;

a second reflector at least partially disposed on a second side of the lamp opposite the first side; and a substantially transparent thermal cover positioned over one end of the lamp to at least partially enclose a portion of the lamp.

2. The light fixture of claim 1, wherein the cover further comprises:

an end located adjacent to the end of the lamp and oriented substantially perpendicular to the lamp and reflectors; and a first side wall coupled to and positioned substantially normal to the end of the cover.

3. The light fixture of claim 2, wherein the first wall of the thermal cover is adjacent to the first reflector and the cover further comprises:

a second wall opposite the first wall and coupled to the end of the cover;

a third wall coupled to the first wall, the second wall, and the end of the cover; and a fourth wall opposite the third wall and coupled to the first wall, the second wall, and the end of the cover.

4. A sign, comprising:

a ballast;

a plurality of light fixtures, each light fixture including a closed loop, high intensity discharge lamp having an outer periphery;

a first reflector positioned on a first side of the lamp, the first reflector having a plurality of transmissive areas and a plurality of reflective areas allowing a portion of the light emitted from the lamp to transmit through the first reflector and a portion of the light to be reflected; and a sign housing having a first output panel that has a diffusive, translucent surface that outputs light emitted by the lamp.

5. The sign as claimed in claim 4, wherein the light fixture further comprises a second reflector positioned on a second side of the lamp opposite the first side.

6. The sign as claimed in claim 5, wherein the second reflector has a plurality of transmissive areas and a plurality of reflective areas allowing a portion of the light emitted from the lamp to transmit through the second reflector and a portion of the light to be reflected.

7. The sign as claimed in claim 5, wherein the second reflector is a specular reflector.

8. The sign as claimed in claim 4, wherein the sign housing further comprises a second output panel located on the opposite side of the light fixtures from the first output panel, the second output panel having a diffusive, translucent surface that outputs light emitted by the lamp.

9. The sign as claimed in claim 4, wherein the sign housing further comprises at least one side wall and a back wall, each having a diffusive reflective surface adjacent the light fixtures.

10. The sign as claimed in claim 4, further comprising:

a second ballast; and a second plurality of light fixtures including a closed loop, high intensity discharge lamp;

a reflector positioned on one side of the panel.

* * * * *